United States Patent [19]

Matsuura

[11] 3,934,404

[45] Jan. 27, 1976

[54] SECOND HAND REGULATING MECHANISM

[75] Inventor: Eiichi Matsuura, Chiba, Japan

[73] Assignee: Kabushiki Kaisha Daini Seikosha, Japan

[22] Filed: Nov. 14, 1974

[21] Appl. No.: 523,893

[30] Foreign Application Priority Data

Nov. 17, 1973 Japan ..... 48-132949

[52] U.S. Cl. ..... 58/116 R; 58/23 D

[51] Int. Cl.[2] ..... G04B 15/00; G04C 3/00

[58] Field of Search ..... 58/23 R, 23 TF, 116 R, 58/23 D, 7, 59, 74, 75

[56] References Cited

UNITED STATES PATENTS 3,408,810 11/1968 Meitinger ..... 58/59

3,783,608 1/1974 Miyazawa ..... 58/116 R

*Primary Examiner*—George H. Miller, Jr.

*Attorney, Agent, or Firm*—Robert E. Burns; Emmanuel J. Lobato; Bruce L. Adams

[57] ABSTRACT

A second jumper spring made of a resilient wire is bent at its one end for engaging a fourth wheel or a ratchet-toothed wheel for driving a second hand. The second jumper spring is fixed at the other end on a pin rotatably mounted on a mounting plate which is horizontally movable. The second jumper spring is turnably mounted on the mounting plate and horizontally movable therewith to regulate the fourth wheel or the ratchet-toothed wheel for driving a second hand.

8 Claims, 3 Drawing Figures

SECOND HAND REGULATING MECHANISM

BACK GROUND OF THE INVENTION

This invention relates to a regulating mechanism for a second hand in a watch, and more particularly to a regulating mechanism for a step second hand in a quartz crystal watch.

In the conventional regulating mechanism for a second hand, the second jumper spring has been made of a plate and provided with a stone engaging with a fourth wheel or a ratchet-toothed wheel arranged coaxially with the fourth wheel for driving a second hand. This, in turn, has resulted in the difficulty in bending the jumper spring and the necessity of an adhesive to adhere the stone thereto. In addition, the manufacturing cost has been expensive because of the complex working.

SUMMARY OF THE INVENTION

It is therefore an object of the present invention to provide a regulating mechanism for a second hand having an improved second jumper spring of simple construction and at low cost.

It is another object of the present invention to provide a regulating mechanism for a second hand which eliminates the above-mentioned defects.

DESCRIPTION OF THE PREFERRED EMBODIMENTS

The present invention will be fully described by way of the presently preferred embodiment in connection with the accompanying drawings.

Figure 1:
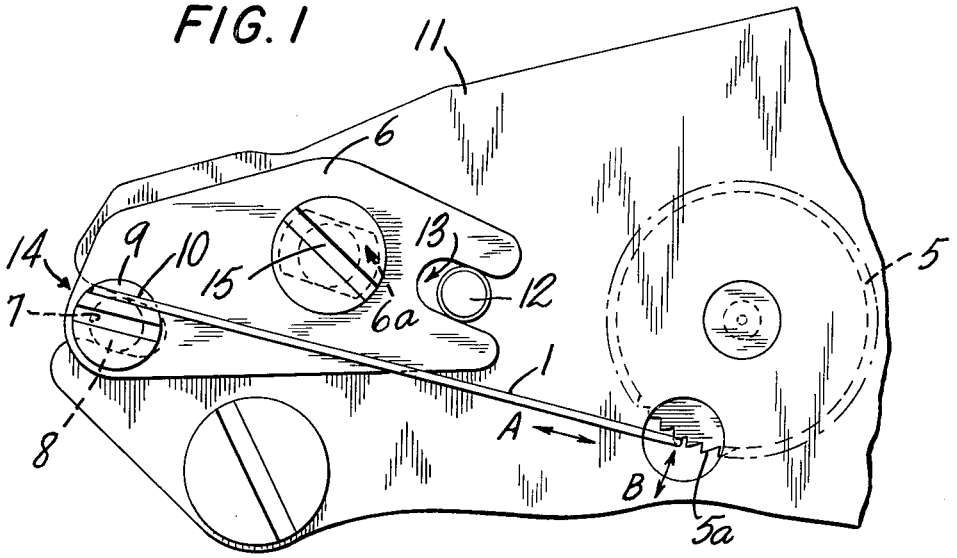
FIG. 1 shows a front view of an embodiment of the present invention.
Figure 2:
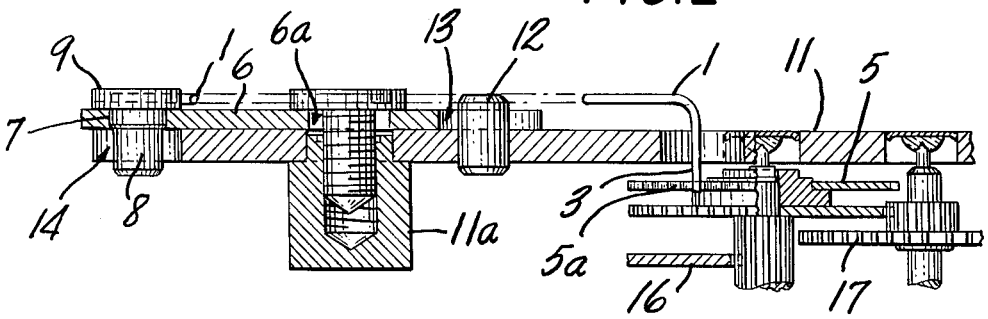
FIG. 2 is a side view showing the embodiment with a part cut away.

In FIGS. 1 and 2, a second jumper spring 1 is made of a resilient wire which is bent at about 90° at its one end to form a bent end 3. The bent end 3 of the second jumper spring 1 engages with ratchet teeth 5*a* of a ratchet-toothed wheel 5 for driving a second hand (not shown). A first pin 8 is inserted and fitted with a hole 7 formed in a mounting plate or mount on which the second jumper spring 1 is mounted. The pin 8 carries a head 9 in which a slot 10 is formed. The base end of the second jumper spring 1 is laid horizontally in the slot 10 of the head of the first pin 8. It is to be noted that the bent end 3 of the second jumper spring can be turned in the direction of the arrow B in FIG. 1 by turning the first pin 8 thereby adjusting the position and degree of engagement between the second jumper spring 1 and the wheel 5. A second pin 12 is fixed on a plate member or bridge 11 and engages in a recess 13 formed in the mounting plate 6. The bridge 11 is also provided with a recess 14 substantially parallel to the recess 13, which is formed in the mounting plate 6, for receiving the lower portion of the first pin 8. A screw 5 is inserted in a center opening 6*a* of the mount 6 and further inserted in an internal thread of a block 11*a* fixed to the bridge 11. The center opening 6*a* of the mounting plate 6 has a larger diameter than that of the screw 15 as seen in FIGS. 1 and 2, so as to permit movement of the mounting plate 6 relative to both the screw 15 and the bridge 11. By such a construction, the mounting plate 6 can be moved in the direction of the arrow A within the space of the opening 6*a* when the tightened screw 15 is loosened so that the engagement position between the vertically bent end 3 of the second jumper spring 1 and the ratchet teeth 5*a* of the ratchet-toothed wheel 5 may be adjusted. In addition, a third wheel 16 and a fifth wheel 17 are shown in FIG. 2.

As mentioned above, since the second jumper spring 1 is made of resilient wire and is bent at its one end for engagement with the teeth of the fourth wheel or ratchet teeth 5*a* of the ratchet-toothed wheel 5, the bent end 3 of the second jumper spring may be easily positioned in the neutral of the fourth wheel. Further, the bent end 3 of the second jumper spring made of resilient wire serves to regulate the fourth wheel (or the ratchet-toothed wheel). Furthermore, it is possible to adjust the engagement between the end 3 of the second jumper spring 1 and the fourth wheel since the second jumper spring is moved together with the mounting plate 6 which may be horizontally moved under the guide of the pins 8 and 12 when the screw 15 is loosened and also is turned together with the pin 8 which is turned in the recess 14 of the bridge and in the hole 7 of the mounting plate 6. Moreover, working and assembling of the regulating mechanism are so easy that the cost of assembly and repair are decreased as compared to to the prior art constructions.

Figure 3:
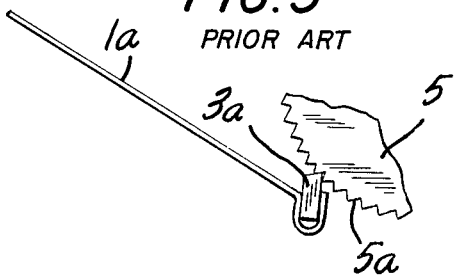
FIG. 3 PRIOR ART
FIG. 3 is a front view showing a conventional second jumper spring made of a plate.

A typical prior art construction is shown in FIG. 3 and such includes a stone 3*a* affixed to the end of a second jumper spring plate 1*a*. The stone 3*a* engages with the ratchet teeth 5*a* of ratchet-toothed wheel 5 whereas according to the invention, the bent end of the second jumper spring itself engages the ratchet teeth.

What is claimed is:

1. In a regulating mechanism for a timepiece second hand: a rotary ratchet-toothed wheel rotationally driven during use in a forward rotational direction for driving a timepiece second hand; a second jumper spring having an elongated major portion and terminating at one end in a projection which projects generally transversely of said major portion; and means mounting said second jumper spring so that said major portion thereof lies in a plane which is generally parallel to and spaced from the plane in which said ratchet-toothed wheel lies and with said projection in direct engagement with the teeth of said ratchettoothed wheel to effectively prevent reverse rotation thereof.

2. A regulating mechanism according to claim 1; wherein said means mounting said second jumper spring includes means mounting the same for both radial movement and tangential movement relative to said ratchet-toothed wheel to enable adjustment of the engaging position of said projection relative to the teeth of said ratchet-toothed wheel.

3. A regulating mechanism according to claim 2; wherein said means mounting said second jumper spring comprises a mounting plate, means turnably mounting the other end of said scond jumper spring on said mounting plate to thereby enable radial movement of said projection in response to turning movement of said other end, a plate member superposed on said mounting plate, and means mounting said mounting plate for sliding movement on said plate member along a given axis to thereby enable tangential movement of said projection in response to sliding movement of said mounting plate along said given axis.

4. A regulating mechanism according to claim 3; including locking means for releasably locking said mounting plate and said other end of said second jumper spring in their adjusted and preselected positions.

5. A regulating mechanism according to claim 3; wherein said second jumper spring is composed of resilient wire which is bent at said one end thereof at an angle of about 90° to form said projection.

6. A regulating mechanism according to claim 3; wherein said means mounting said mounting plate for sliding movement comprises means defining an enlarged opening in said mounting plate, and a screw having a head larger than said enlarged opening and a threaded shaft extending through said enlarged opening and being threaded into said plate member so that upon loosening of said screw said mounting plate may be slid along said one axis on said plate member to effect tangential adjustment of said projection.

7. A regulating mechanism according to claim 6; wherein said means mounting said mounting plate for sliding movement further includes means defining a pair of generally parallel elongated recesses, one in said mounting plate and one in said plate member, having a direction of elongation generally parallel to said given axis, and a pair of pins, one mounted on said plate member and one mounted on said mounting plate, slidably received within respective ones of said elongated recesses to ensure sliding movement of said mounting plate along said given axis.

8. A regulating mechanism according to claim 7; wherein said pin which is mounted on said mounting plate comprises a turnably mounted pin mounted for turning movement relative to said mounting plate, and means connecting said other end of said second jumper spring to said pin so that turning movement thereof effects radial movement of said projection.

* * * * *